US010472199B1

(12) United States Patent
Hoover

(10) Patent No.: US 10,472,199 B1
(45) Date of Patent: Nov. 12, 2019

(54) CREEL SAFETY LATCH, OVERHEAD BOBBIN CREEL, AND METHOD FOR LOADING AND UNLOADING AN OVERHEAD BOBBIN CREEL

(71) Applicant: American Linc, LLC, Gastonia, NC (US)

(72) Inventor: Donald Lynn Hoover, Clover, SC (US)

(73) Assignee: American Linc, LLC, Gastonia, NC (US)

( * ) Notice: Subject to any disclaimer, the term of this patent is extended or adjusted under 35 U.S.C. 154(b) by 123 days.

(21) Appl. No.: 15/700,846

(22) Filed: Sep. 11, 2017

Related U.S. Application Data

(60) Provisional application No. 62/385,483, filed on Sep. 9, 2016.

(51) Int. Cl.
*B65H 49/16* (2006.01)
*D01H 1/18* (2006.01)
*B65H 49/12* (2006.01)

(52) U.S. Cl.
CPC ..... *B65H 49/16* (2013.01); *B65H 49/12* (2013.01); *D01H 1/18* (2013.01); *B65H 2701/31* (2013.01)

(58) Field of Classification Search
CPC ..... B65H 49/12; B65H 49/16; B65H 49/22; B65H 2701/31; B65H 67/02; D01H 1/18; D01H 1/183; D01H 9/005; D02H 1/00
USPC ..... 57/266–275
See application file for complete search history.

(56) References Cited

U.S. PATENT DOCUMENTS 3,304,026 A * 2/1967 Bucklow ..... B65H 49/16 242/131
4,163,357 A * 8/1979 Greive ..... D02G 3/285 242/131.1
4,175,717 A 11/1979 Mathiolon et al.
4,180,967 A * 1/1980 Greive ..... B65H 49/12 57/276
4,240,594 A * 12/1980 David, Jr. ..... D01H 1/18 242/131
4,464,891 A * 8/1984 Manly, Jr. ..... D01H 1/18 242/131
4,894,982 A * 1/1990 Bianchi ..... D02G 3/285 57/58.3
4,932,198 A 6/1990 Eisenhauer et al.
(Continued)

FOREIGN PATENT DOCUMENTS

DE 2726603 A1 * 12/1978 ..... B65H 49/12
DE 2759419 C2 * 3/1985 ..... B65H 49/12
(Continued)

*Primary Examiner* — William E Dondero
(74) *Attorney, Agent, or Firm* — Schwartz Law Firm, P.C.

(57) ABSTRACT

A creel safety latch includes an elongated pivot-control bar defining a longitudinal slot having first and second terminal ends. The slot is adapted for receiving a latch pin of a movable bobbin creel. A first pin catch is located proximate the first terminal end of the slot, such that sliding movement of the latch pin along the slot and beyond the first catch locates the latch pin in a first holding position directly adjacent the first terminal end of the slot. A second pin catch is located proximate the second terminal end of the slot, such that sliding movement of the latch pin along the slot and beyond the second catch locates the latch pin in a second holding position directly adjacent the second terminal end of the slot.

19 Claims, 12 Drawing Sheets

(56) References Cited

U.S. PATENT DOCUMENTS

| | | | | |
|---|---|---|---|---|
| 6,513,314 | B2 * | 2/2003 | Cook | D02G 3/285 57/352 |
| 6,786,441 | B2 * | 9/2004 | Osterloh | B65H 49/16 242/129 |
| 6,848,641 | B2 * | 2/2005 | Lohmann | B65H 49/16 242/129 |
| 7,353,646 | B1 | 4/2008 | Copeland | |
| 8,033,089 | B2 * | 10/2011 | Leupers | D02G 3/285 57/58.52 |
| 2002/0100268 | A1 * | 8/2002 | Gabalda | B65H 49/12 57/58.3 |
| 2003/0201354 | A1 * | 10/2003 | Osterloh | B65H 49/16 242/131 |
| 2003/0201355 | A1 * | 10/2003 | Lohmann | B65H 49/16 242/131 |
| 2005/0082404 | A1 * | 4/2005 | Beckmann | D01H 1/18 242/129 |

FOREIGN PATENT DOCUMENTS

| | | | | | |
|---|---|---|---|---|---|
| EP | 1502974 | A2 * | 2/2005 | | D01H 1/18 |
| EP | 1502975 | A2 * | 2/2005 | | B65H 59/22 |
| FR | 1380966 | A * | 12/1964 | | D01H 1/18 |
| FR | 2794136 | A1 * | 12/2000 | | B65H 49/16 |
| JP | 2005048311 | A * | 2/2005 | | B65H 59/22 |
| JP | 2005048312 | A * | 2/2005 | | D01H 1/18 |

* cited by examiner

CREEL SAFETY LATCH, OVERHEAD BOBBIN CREEL, AND METHOD FOR LOADING AND UNLOADING AN OVERHEAD BOBBIN CREEL

TECHNICAL FIELD AND BACKGROUND OF THE DISCLOSURE

The present disclosure relates broadly and generally to a mechanical creel safety latch, overhead pivoted bobbin creel, and method for loading and unloading an overhead pivoted bobbin creel. In exemplary embodiments, the present safety latch may be incorporated in an overhead bobbin creel designed for holding thread bobbins (or yarn packages) in a spinning or cabling machine, such as that disclosed in U.S. Pat. No. 4,932,198—the complete disclosure of which is incorporated herein by reference. Examples of prior art creels are disclosed in U.S. Pat. Nos. 4,175,717 and 4,932,198. The complete disclosure of these prior patents is incorporated herein by reference.

Textile yarn processing machines require a supply of unprocessed yarn. Many such machines are supplied with yarn drawn from one of a large number of packages (or bobbins) mounted in a creel structure standing near to the machine. Reserve packages are generally mounted adjacent each supply package, and the two packages have their yarn ends joined so that yarn is automatically transferred to the reserve package when the first package is exhausted. The exhausted package is then replaced by a new full package which then becomes the reserve package. In this manner, the supply of unprocessed yarn to each station of the yarn processing machine is continuously maintained.

The issue of temporarily securing bobbin creels in a lowered position during placement of heavy thread bobbins on spindles is known in the art. As discussed in prior U.S. Pat. No. 7,353,646, certain cabling machines are provided with a plurality of cabling stations. Each cabling station has a bobbin creel, with each bobbin creel in turn having a creel support arm supporting the bobbin creel and associated spindles upon which cord or thread bobbins are mounted. Because of the relatively high weight of bobbins filled with cord, the upper bobbin creels are designed with bobbin creel support arms or members pivotally mounted and enabled to be pulled downward to a location approximately chest high so as to minimize a height to which the loaded bobbins must be lifted by workers for mounting on the spindles supported by the bobbin creel. The remainder of U.S. Pat. No. 7,353,646 is incorporated herein by reference.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a creel safety latch for an overhead movable bobbin creel. The bobbin creel is adapted for pivoting movement between a raised operating position and a lowered package donning/doffing position. The creel safety latch comprises an elongated pivot-control bar defining a longitudinal slot having first and second terminal ends. The slot is adapted for receiving a latch pin of the movable bobbin creel. A first pin catch is located proximate the first terminal end of the slot, such that sliding movement of the latch pin along the slot and beyond the first catch locates the latch pin in a first holding position directly adjacent the first terminal end of the slot. This temporarily secures the bobbin creel in the raised operating position. A second pin catch is located proximate the second terminal end of the slot, such that sliding movement of the latch pin along the slot and beyond the second catch locates the latch pin in a second holding position directly adjacent the second terminal end of the slot. This temporarily securing the bobbin creel in the lowered package donning/doffing position.

According to another exemplary embodiment, the pivot-control bar defines opposing cylindrical cavities at each of the first and second pin catches.

According to another exemplary embodiment, the first pin catch comprises cooperating opposing spring-loaded detents located substantially within respective cylindrical cavities.

According to another exemplary embodiment, each detent comprises a metal ball.

According to another exemplary embodiment, each cylindrical cavity has a reduced diameter opening adjacent the slot, such that a portion of the metal ball is capable of extending outwardly from the cavity and into the slot.

According to another exemplary embodiment, a spring is located inside each cylindrical cavity and operates to normally urge the metal ball outward from the cavity and into the slot.

According to another exemplary embodiment, the second pin catch comprises cooperating opposing spring-loaded detents located substantially within respective cylindrical cavities. The second pin catch may be identical to the first pin catch, and may comprise identical components which function in a manner identical to those of the first pin catch.

In yet another exemplary embodiment, the present disclosure comprises an overhead bobbin creel adapted for pivoting movement between a raised operating position and a lowered package donning/doffing position. The bobbin creel comprises a movable arcuate creel arm having at least one package mounting post (or spindle or "bobbin pin"). A creel safety latch operatively interconnects the arcuate creel arm and a pivot linkage attached to an adjacent support frame. The creel safety latch may be constructed according to any one of the exemplary embodiments described further herein.

The term "creel" is defined broadly herein to mean any support frame or rack located adjacent a textile machine, and capable of holding packages of yarn to supply the operation. "Creeling" refers to the process of mounting yarn packages on the yarn holder of the creel.

The term "bobbin" refers to any spool-like device designed for placement on a spindle or skewer holding thread or yarn. Bobbins may be made of various materials, shapes and constructions.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
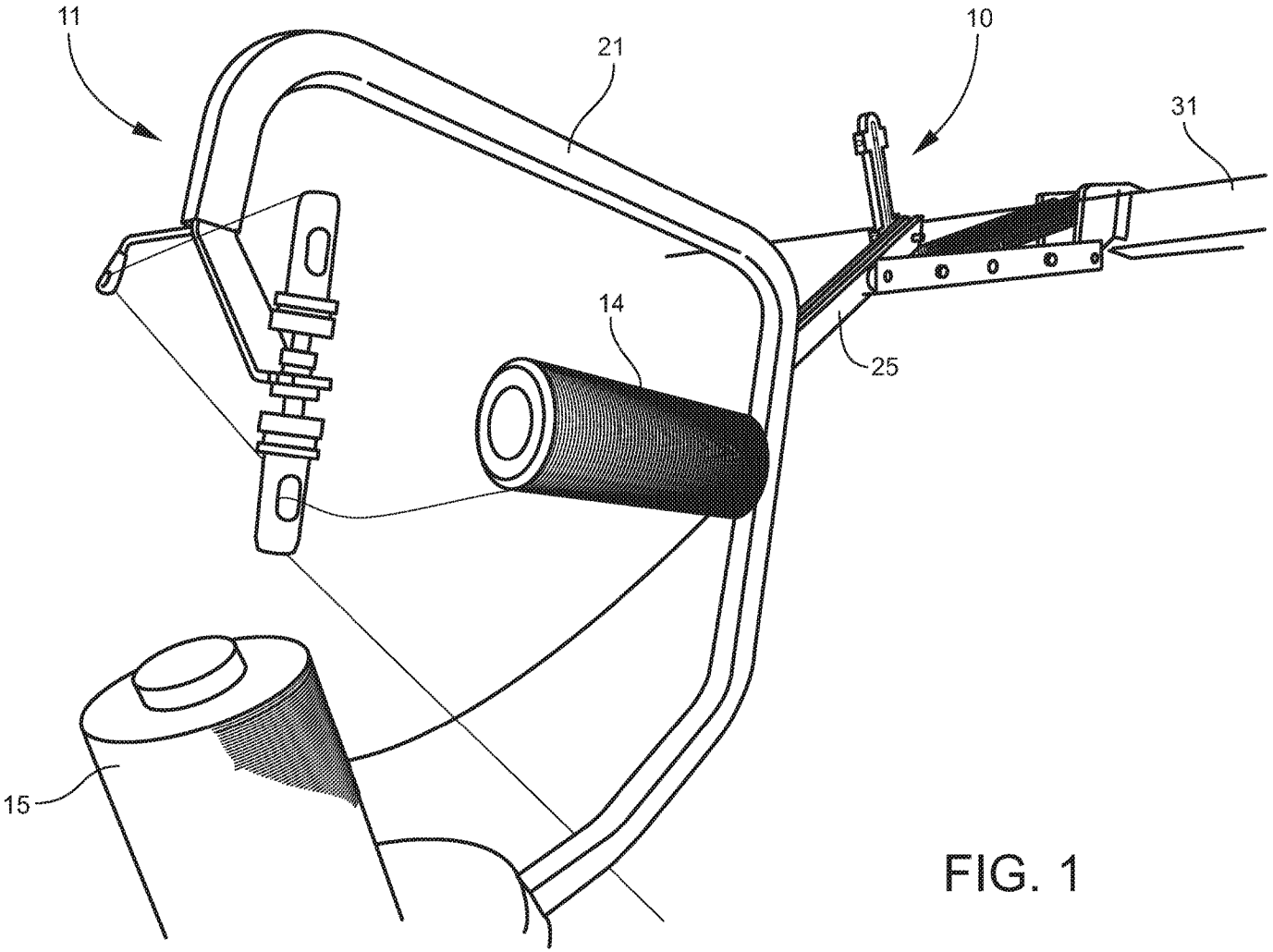
FIG. 1 is an environmental view of the exemplary creel safety latch according to one embodiment of the present disclosure.
Figure 2:
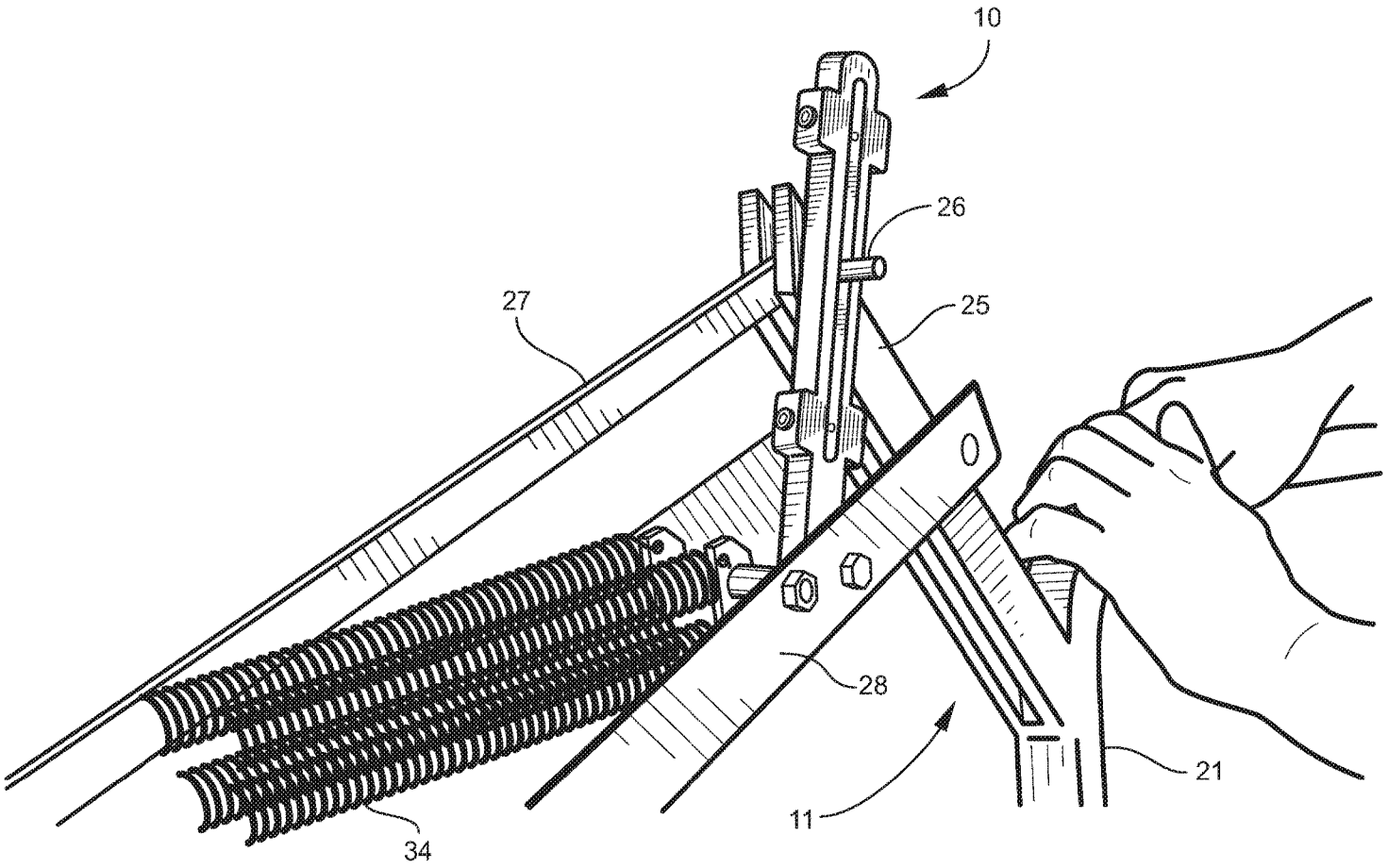
FIG. 2 shows a further environmental view of the exemplary creel safety latch, and demonstrates manual lowering of the bobbin creel from a raised position towards a lowered position.

Referring now specifically to the drawings, a safety creel latch according to one exemplary embodiment of the present disclosure is illustrated in FIG. 1, and shown generally at broad reference number 10. The exemplary safety creel latch 10 is applicable for use in an overhead bobbin creel 11 designed to carry multiple yarn packages (e.g., 14, 15) for supply to an adjacent textile machine. The exemplary creel 11 comprises support structure enabling pivoting movement from a raised machine-operating position to a lowered donning/doffing position in which the creel 11 is manually pulled downward, as demonstrated in FIG. 2, to facilitate replacement of empty yarn packages onto bobbin pins. The exemplary safety latch 10 temporarily holds the creel 11 in the lowered position while the empty packages are replaced, and then temporarily secures the creel 11 in the raised machine-operating position once loaded.

Overhead bobbin creels are well known and commonly used in the textile industry. In one example, a creel unit may have up to nine bobbin creels adjacent one another to service one side of the textile machine, the exemplary machine having 216 processing stations on its two sides with nine bays of twelve stations each per side of machine. Each bobbin creel is adapted for carrying twelve in-use packages and twelve reserve packages to supply the twelve stations per bay, each reserve package being connected by a transfer tail to a processing station when the in-use package is exhausted. When an in-use package is empty, the reserve package becomes the in-use package. The emptied package is unloaded from the creel and a new reserve package loaded. In repeating this process, the exemplary bobbin creel is manually lowered and raised between the package donning/doffing position and the machine-operating position.

Figure 10:
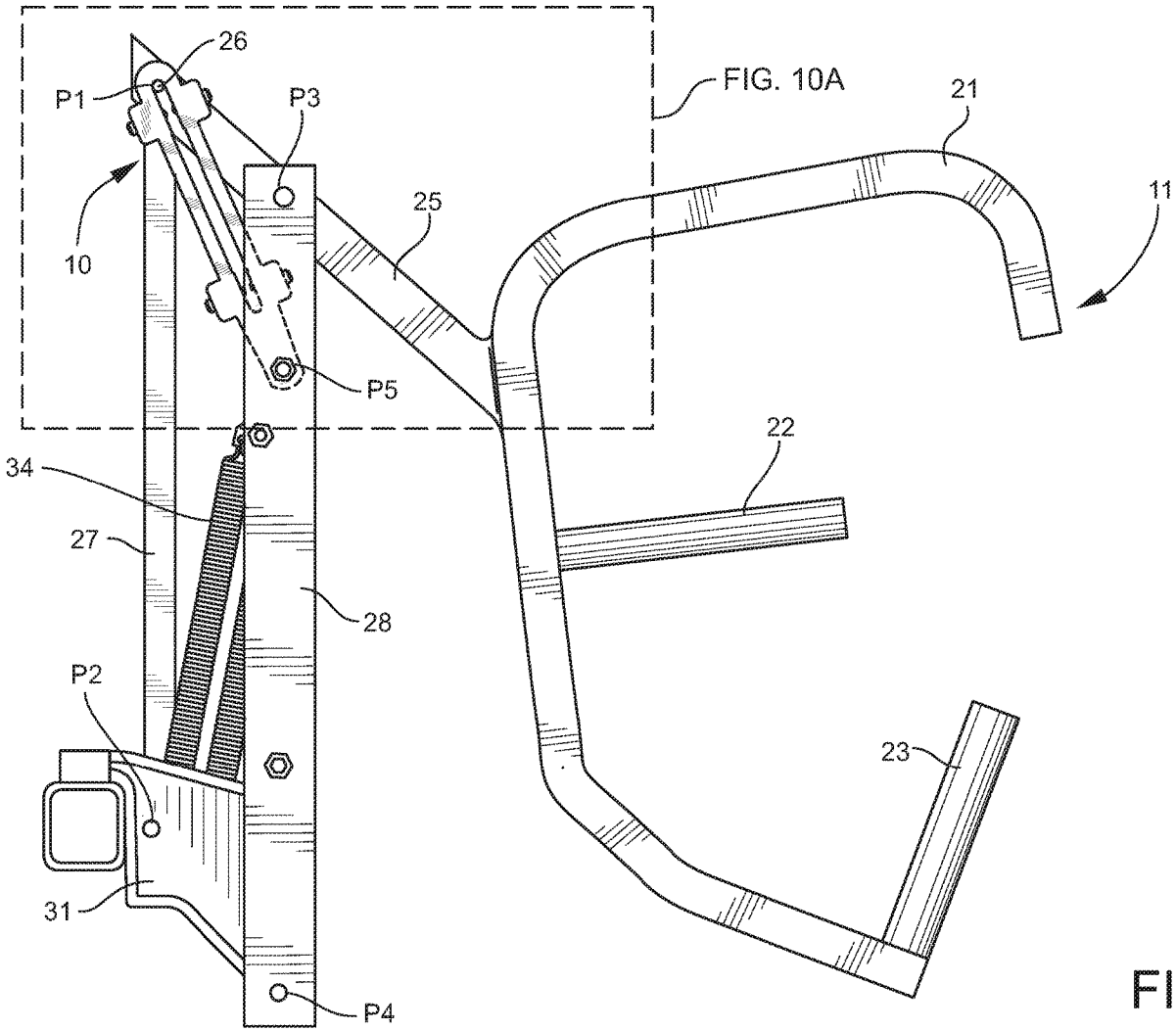
FIGS. 10 and 10A show the exemplary creel safety latch with the bobbin creel in the raised operating position.
Figure 11:
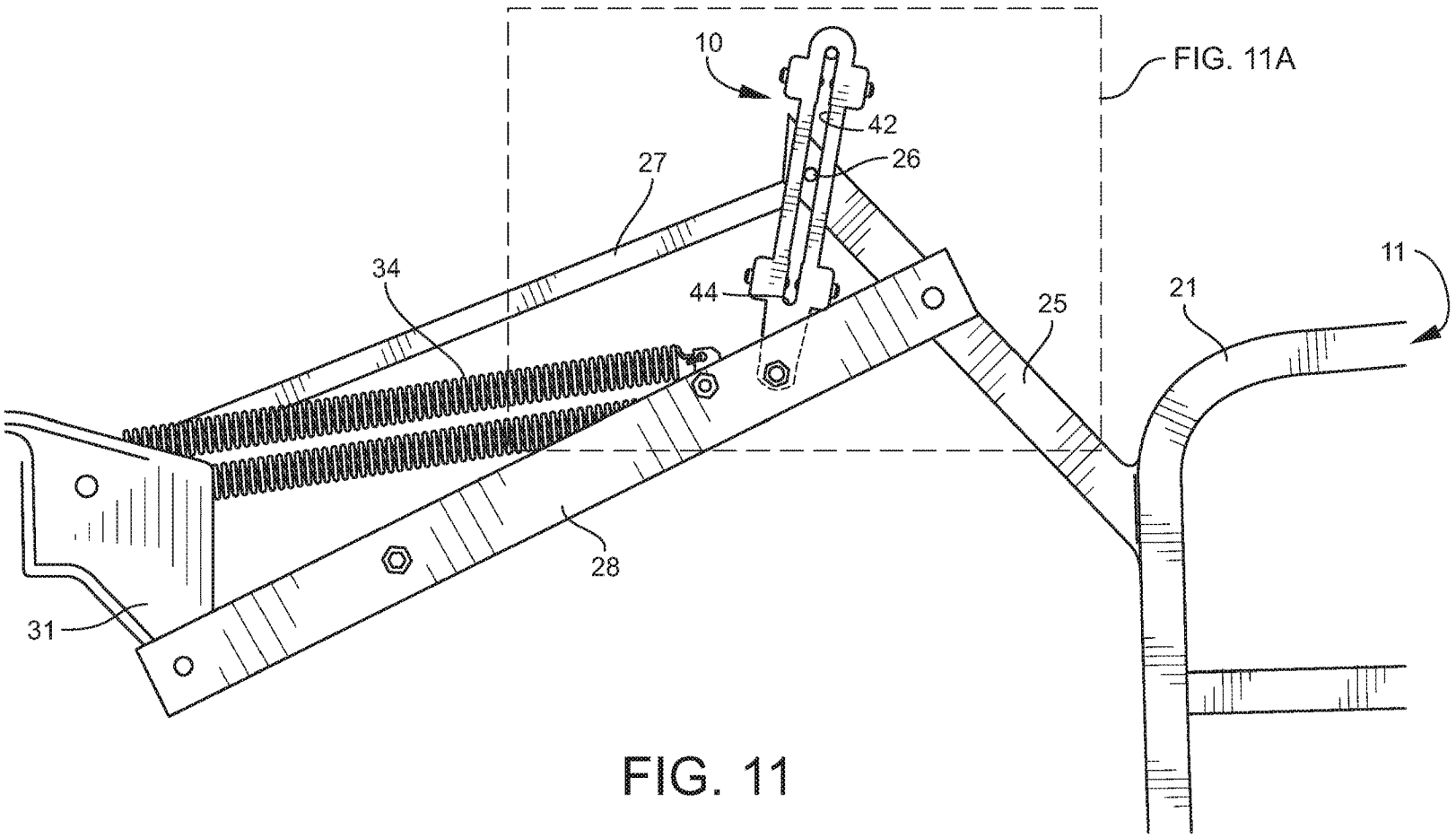
FIGS. 11 and 11A show the exemplary creel safety latch with the bobbin creel in an intermediate position.
Figure 12:
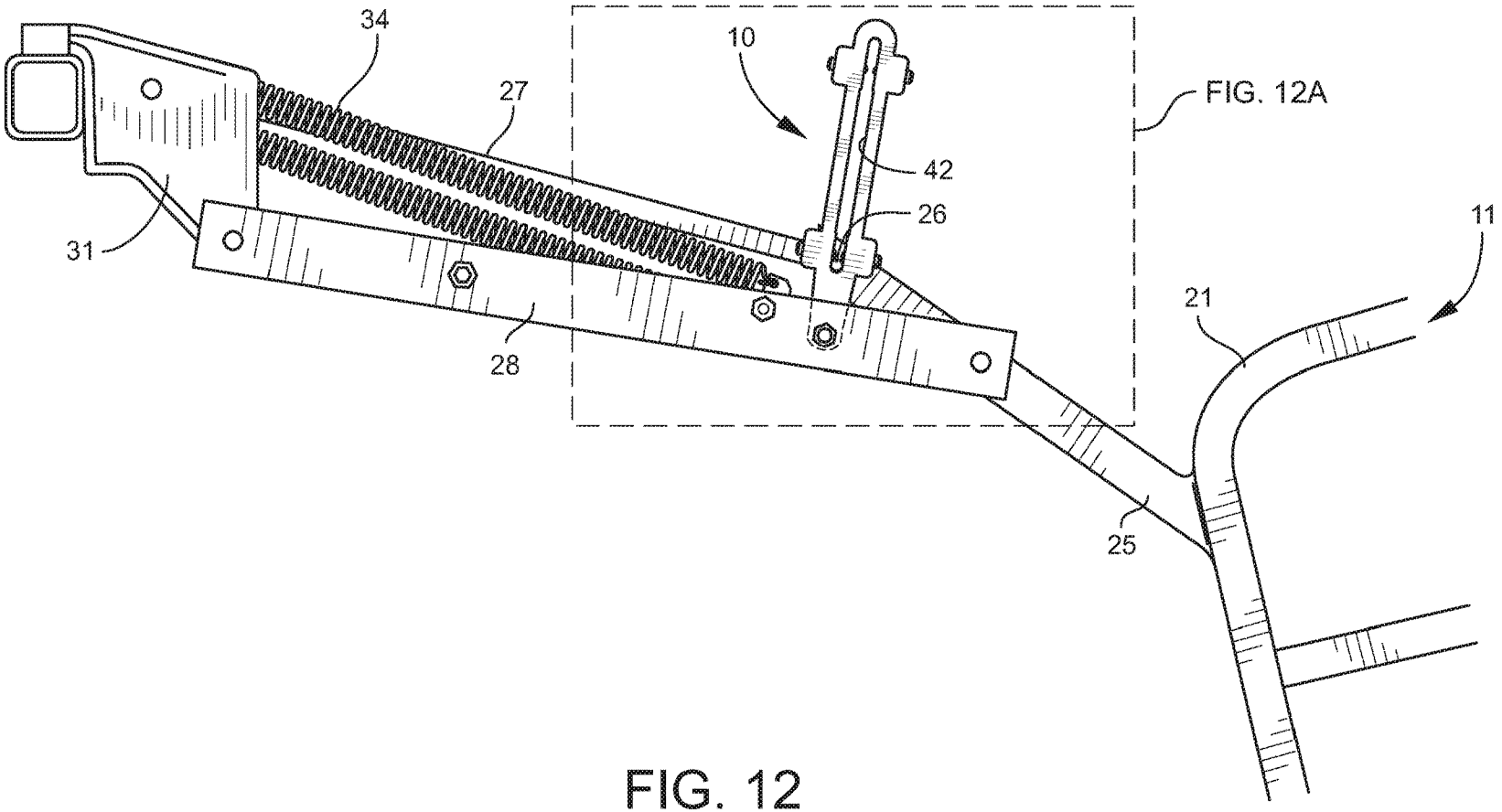
FIGS. 12 and 12A show the exemplary creel safety latch with the bobbin creel in the lowered package donning/doffing position.

In one exemplary embodiment, the present bobbin creel 11 incorporates a generally C-shaped movable creel arm 21 with bobbin pins 22, 23 for holding respective yarn packages, a rear extension 25 fixed to the creel arm 21 and comprises an elongated latch pin 26 (FIG. 2), and upper and lower pivot linkage 27, 28 attached to the rear extension 25. The pivot linkage 27, 28 interconnects the movable creel arm 21 and a fixed support frame 31, and enables manual pivoting of the bobbin creel 11 between its raised machine-operating position and the lowered donning/doffing position. As best shown in FIGS. 10-12, discussed further below, the upper pivot linkage 27 is connected to the rear extension 25 of creel arm 21 at pivot point "P1", and is connected to the fixed support frame 31 at pivot point "P2". The lower pivot linkage 28 connects to the rear extension 25 at pivot point "P3" and to the fixed support frame 31 at pivot point "P4". Springs 34 (or other biasing means) may attach to the fixed support frame 31 and lower pivot linkage 28, and may serve to assist upward pivoting movement of the bobbin creel 11 to its raised operating position after loading.

Figure 3:
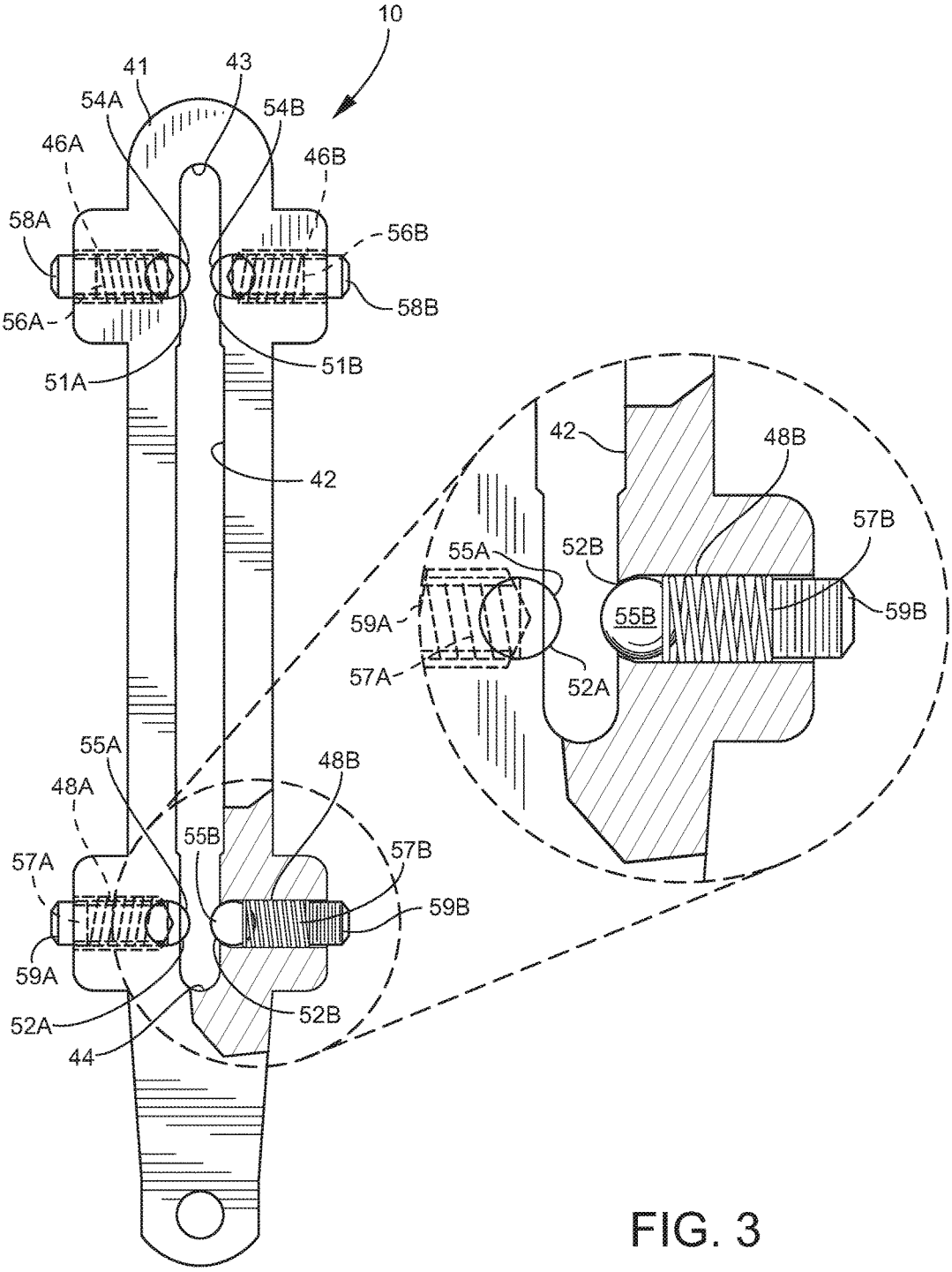
FIG. 3 is a front elevation of the exemplary creel safety latch with portions shown in phantom lines, broken away, and enlarged.
Figure 4:
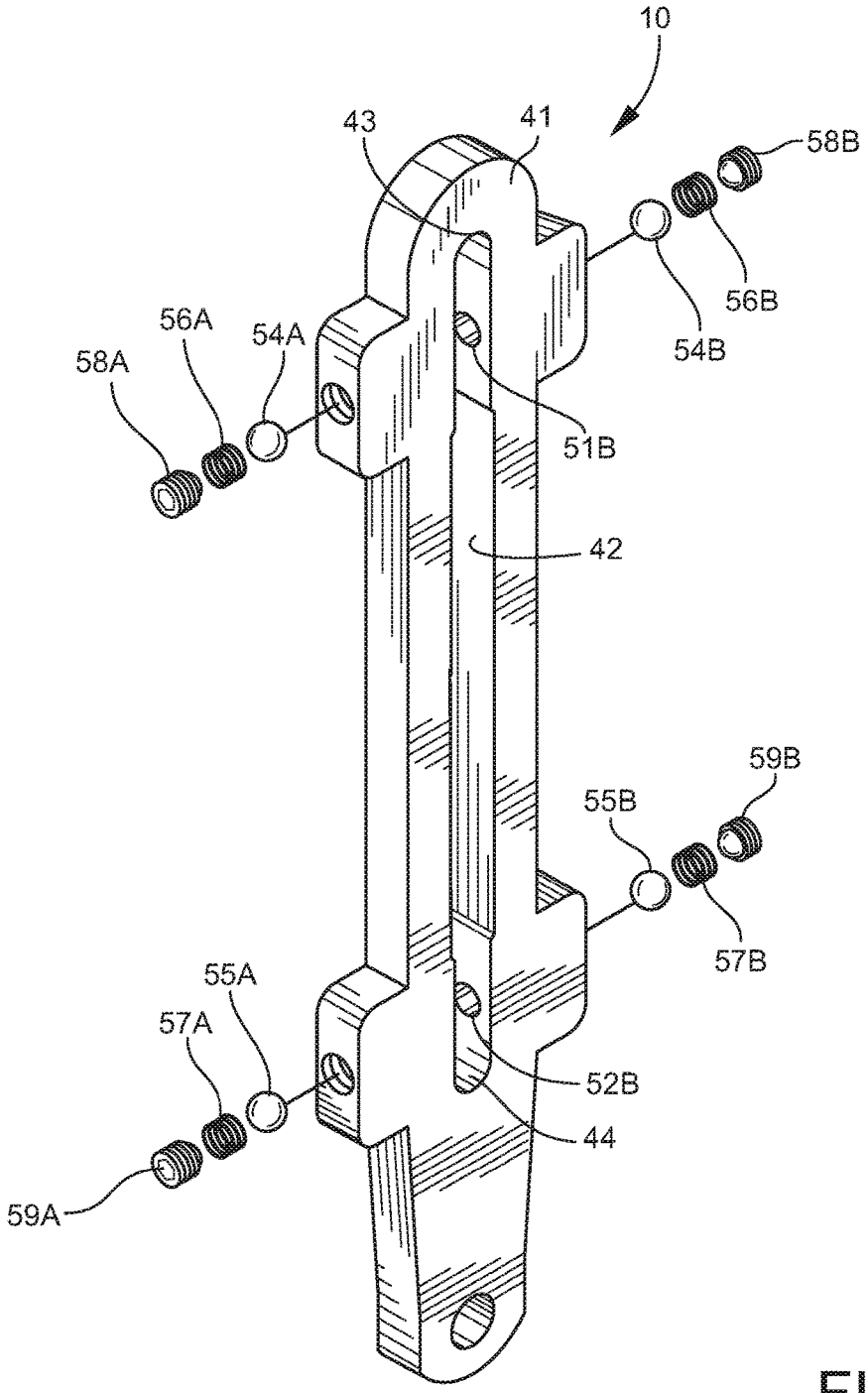
FIG. 4 is an exploded perspective view of the exemplary creel safety latch.
Figure 5:
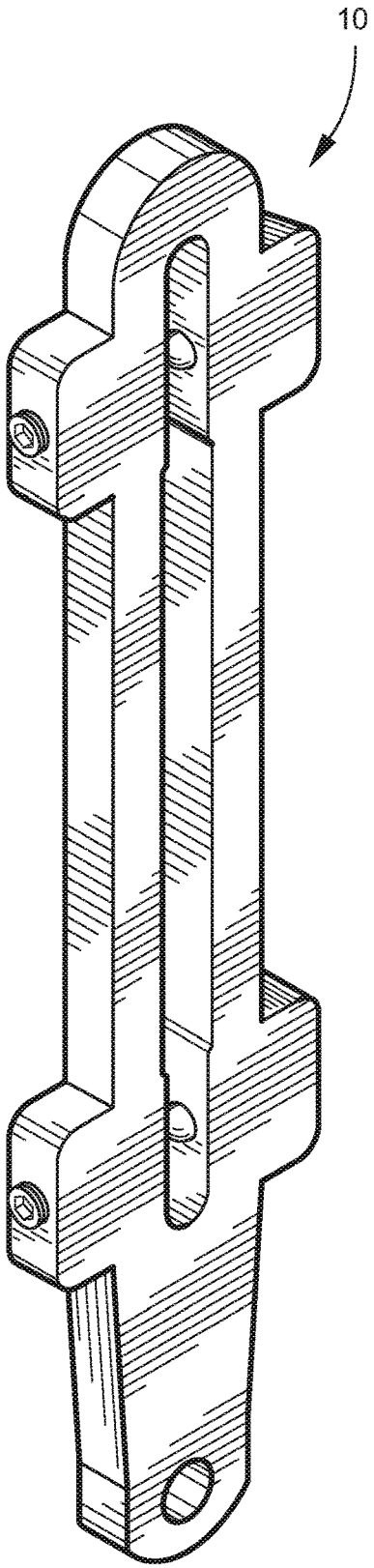
FIG. 5 is an assembled perspective view of the exemplary creel safety latch.
Figure 6:
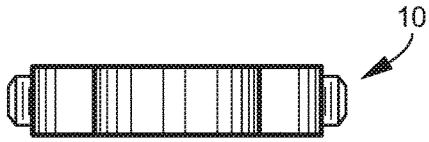
FIG. 6 is a top end view of the exemplary creel safety latch.
Figure 7:
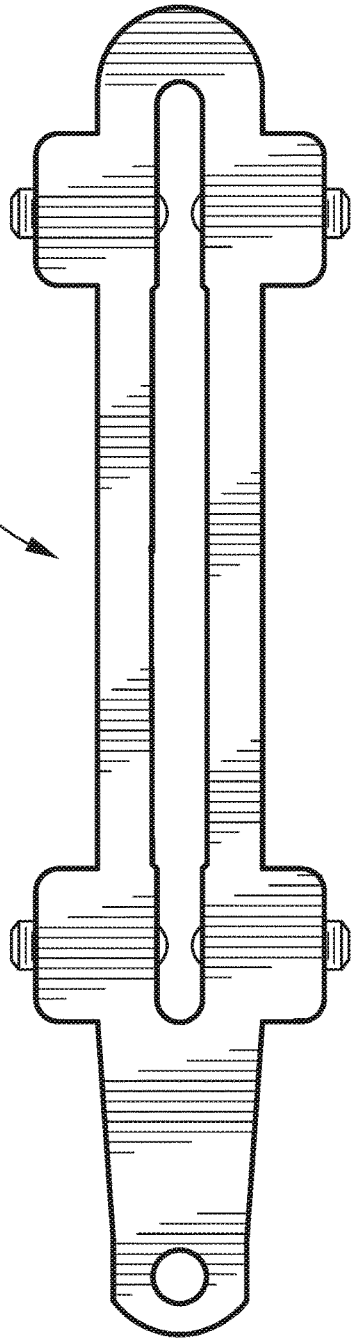
FIG. 7 is a front elevation view of the exemplary creel safety latch.
Figure 8:
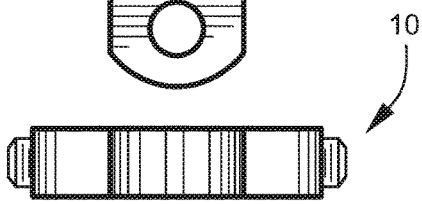
FIG. 8 is a bottom end view of the exemplary creel safety latch.
Figure 9:
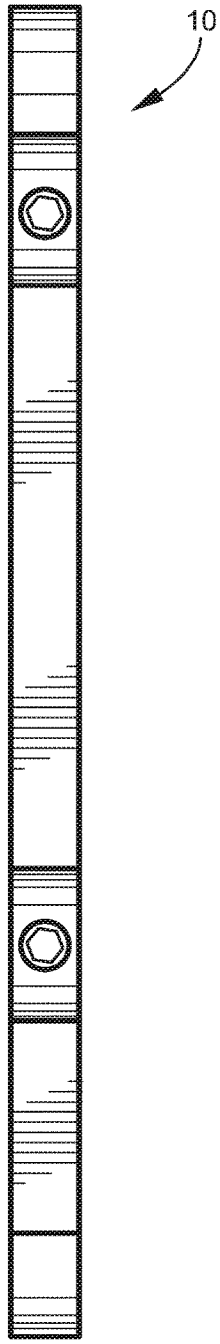
FIG. 9 is a side elevation of the exemplary creel safety latch.

Referring to FIGS. 2-9, the exemplary creel safety latch 10 comprises an elongated metal pivot-control bar 41 defining a longitudinal slot 42 having first and second terminal ends 43, 44, and designed for slidably receiving the latch pin 26 of movable bobbin creel 11. The pivot-control bar 41 is pivotably connected to the lower linkage 28 at point "P5". As best shown in FIGS. 3 and 4, laterally-aligned pairs of cylindrical cavities 46A, 46B and 48A, 48B are formed in respective widened shoulders at opposite ends of the pivot-control bar 41 proximate the first and second terminal ends 43, 44 of the bar slot 42. Each cavity 46A, 46B, 48A, 48B has a reduced diameter opening 51A, 51B, 52A, 52B adjacent the bar slot 42, a metal ball 54A, 54B, 55A, 55B capable of partially extending from the cavity opening 51A, 51B, 52A, 52B into the bar slot 42, a spring 56A, 56B, 57A, 57B for normally urging the metal ball 54A, 54B, 55A, 55B outward from the cavity opening 51A, 51B, 52A, 52B and into the slot 42, and a threaded bolt 58A, 58B, 59A, 59B for retaining the spring 56A, 56B, 57A, 57B and metal ball 54A, 54B, 55A, 55B inside the cavity 46A, 46B, 48A, 48B. The pairs of laterally aligned spring-loaded metal balls 54A, 54B and 55A, 55B cooperate to form respective upper and lower pin catches in the slotted pivot-control bar 41 of safety latch 10.

Figure 10A:
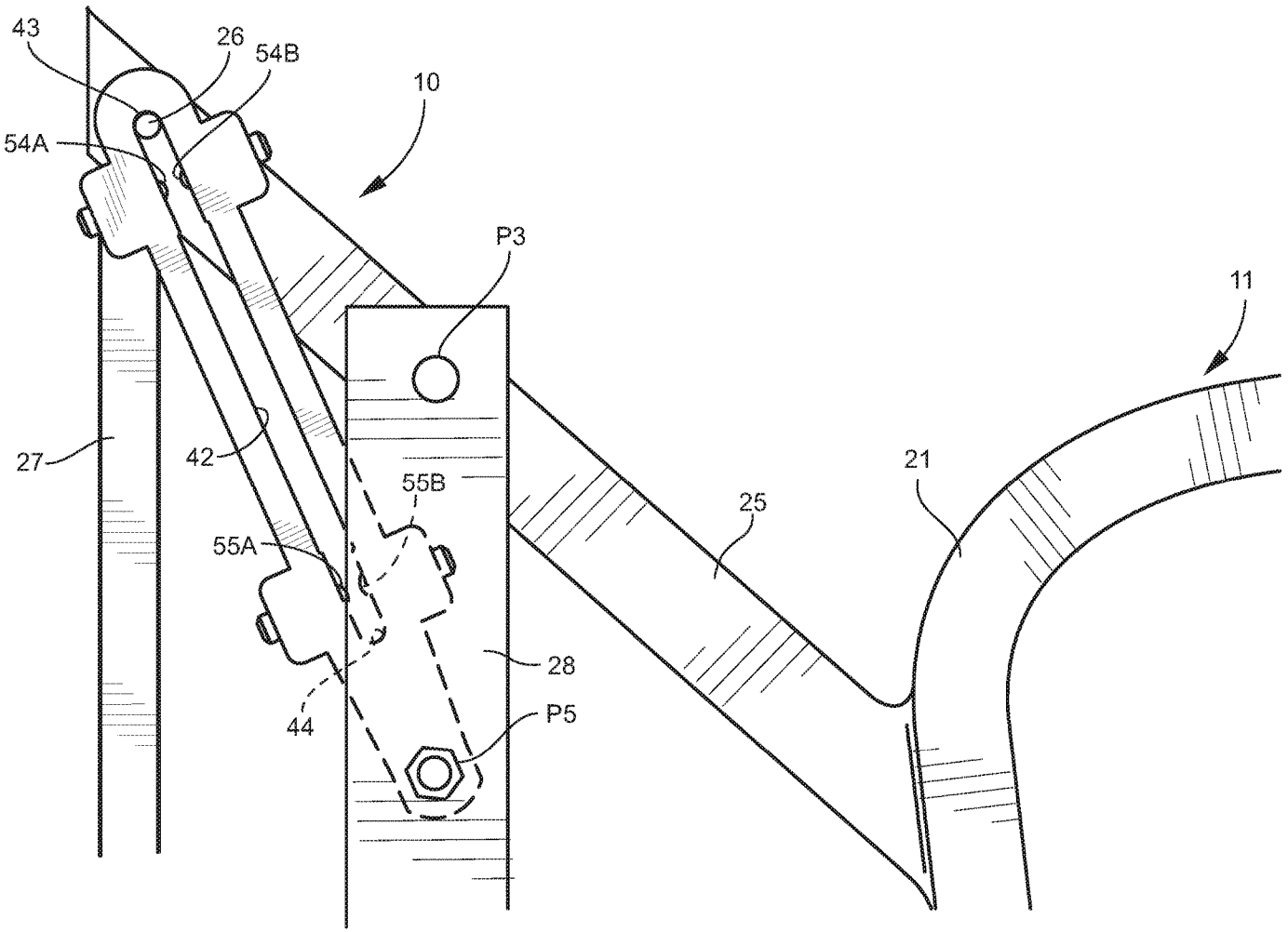
Figure 11A:
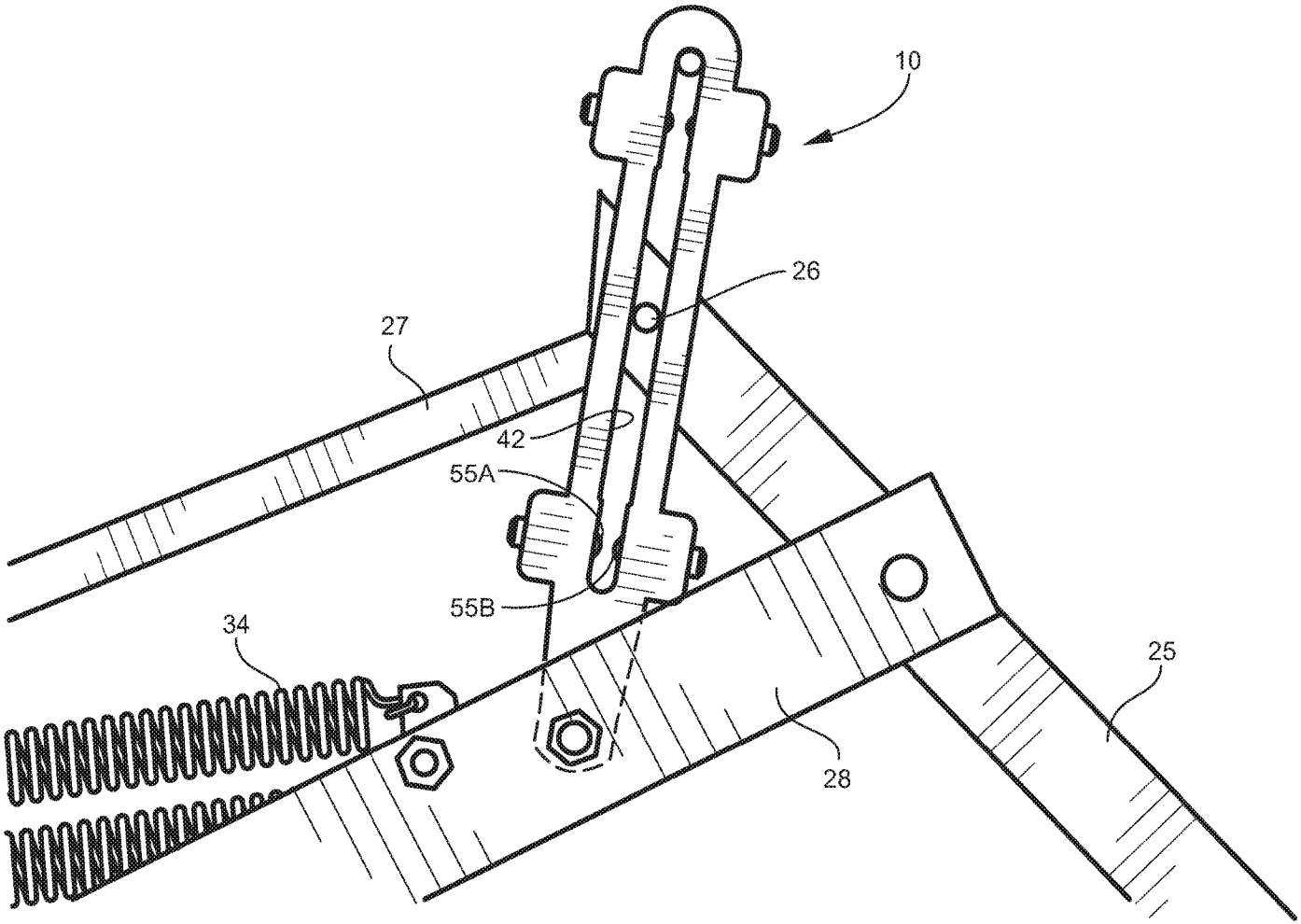
Figure 12A:
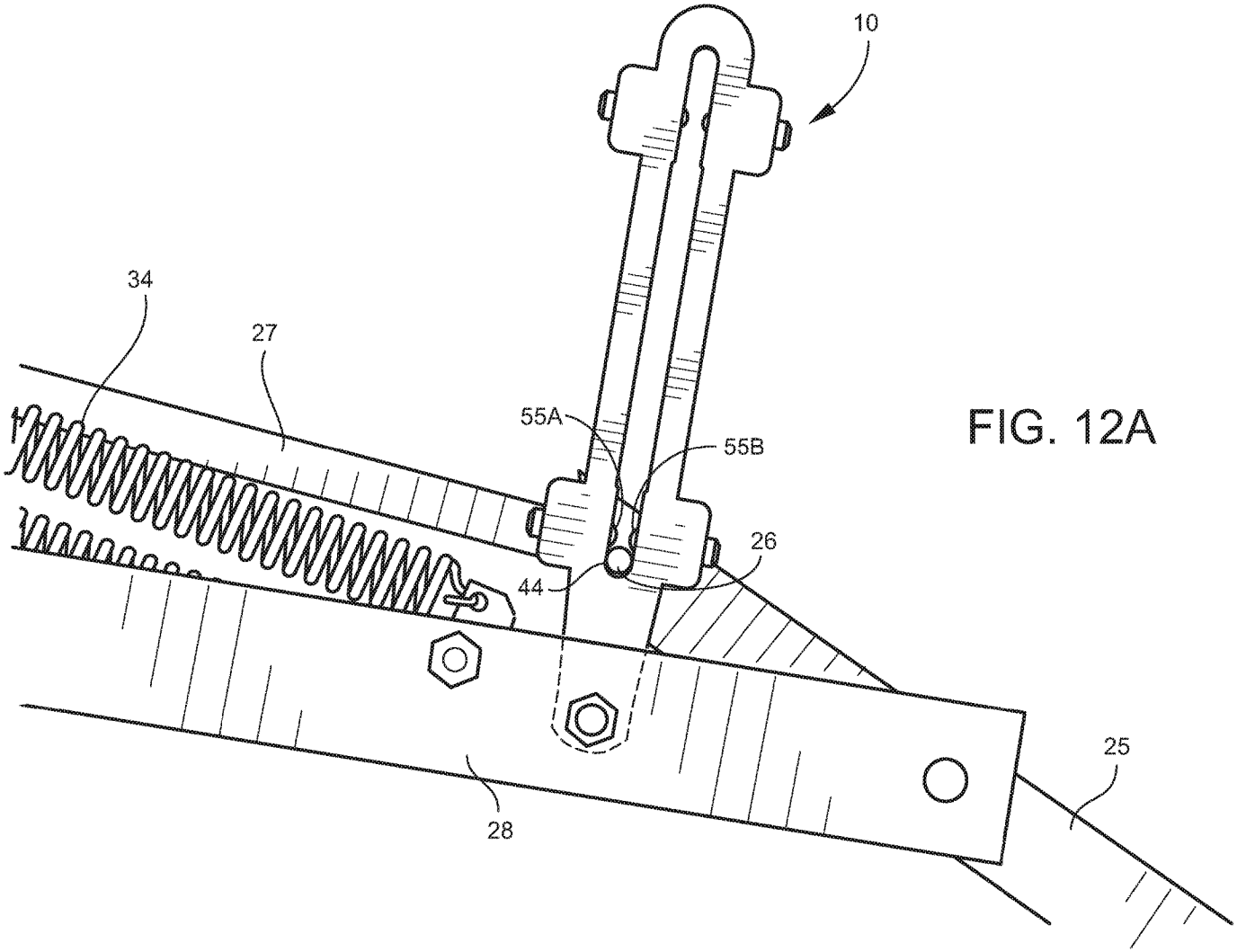

FIGS. 10, 10A, 11, 11A, 12 and 12A demonstrate operation of the exemplary creel safety latch 10, and manual pivoting movement of the bobbin creel 11 from the raised and temporarily secured operating position, shown in FIGS. 10 and 10A, to the lowered and temporarily secured package donning/doffing position, shown in FIGS. 12 and 12A. From the raised position shown in FIGS. 10 and 10A, the operator manually grasps the creel arm 21 and begins pulling downward with slight force. This causes the creel latch pin 26 move from its settled position adjacent the first terminal end 43 of bar slot 42, sliding along the bar slot 42 past the upper catch formed by the first pair of spring-loaded metal balls 54A, 54B. As the operator continues pulling downward on the creel arm 21, the creel springs 34 become tensioned, and the upper and lower pivot linkage 27, 28 adjust as shown in FIGS. 11 and 11A. The latch pin 26 continues sliding downward towards the opposite terminal end 44 of bar slot 42 before temporarily engaging the second pair of spring-loaded balls 55A, 55B. A final slight downward pull of the creel arm 21 causes the latch pin 26 to temporarily urge the spring-loaded balls 55A, 55B outwardly from the slot 42. The latch pin 26 then continues sliding into its creel-holding position directly adjacent the terminal slot end 44. The lower pair of cooperating spring-loaded balls 55A, 55B form a catch in the safety latch 10 sufficient to safely hold the bobbin creel 11 in the lowered position against the tensioned creel springs 34 until all yarn packages are successfully donned and doffed. Once loaded, the bobbin creel 11 can be lifted and returned to the raised operating position in a reverse manner.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A creel safety latch for an overhead movable bobbin creel, the bobbin creel adapted for pivoting movement between a raised operating position and a lowered package donning/doffing position, said creel safety latch comprising:

an elongated pivot-control bar defining a longitudinal slot having first and second terminal ends, and said slot adapted for receiving a latch pin of the movable bobbin creel;

a first pin catch located proximate the first terminal end of said slot, such that sliding movement of the latch pin along said slot and beyond said first catch locates the latch pin in a first holding position directly adjacent the first terminal end of said slot, thereby temporarily securing the bobbin creel in the raised operating position; and a second pin catch located proximate the second terminal end of said slot, such that sliding movement of the latch pin along said slot and beyond said second catch locates the latch pin in a second holding position directly adjacent the second terminal end of said slot, thereby temporarily securing the bobbin creel in the lowered package donning/doffing position, and wherein said pivot-control bar defines opposing cylindrical cavities at each of said first and second pin catches.

2. The creel safety latch according to claim 1, wherein said first pin catch comprises cooperating opposing spring-loaded detents located substantially within respective cylindrical cavities.

3. The creel safety latch according to claim 2, wherein each detent comprises a metal ball.

4. The creel safety latch according to claim 3, wherein each cylindrical cavity has a reduced diameter opening adjacent said slot, such that a portion of said metal ball is capable of extending outwardly from said cavity and into said slot.

5. The creel safety latch according to claim 4, and comprising a spring located inside each cylindrical cavity and operating to normally urge said metal ball outward from said cavity and into said slot.

6. The creel safety latch according to claim 1, wherein said second pin catch comprises cooperating opposing spring-loaded detents located substantially within respective cylindrical cavities.

7. The creel safety latch according to claim 6, each detent comprises a metal ball.

8. The creel safety latch according to claim 7, wherein each cylindrical cavity has a reduced diameter opening adjacent said slot, such that a portion of said metal ball is capable of extending outwardly from said cavity and into said slot.

9. The creel safety latch according to claim 8, and comprising a spring located inside each cylindrical cavity and operating to normally urge said metal ball outward from said cavity and into said slot.

10. A creel safety latch for an overhead movable bobbin creel, the bobbin creel adapted for pivoting movement between a raised operating position and a lowered package donning/doffing position, said creel safety latch comprising:

an elongated pivot-control bar defining a longitudinal slot having first and second terminal ends, and said slot adapted for receiving a latch pin of the movable bobbin creel;

a first pair of cooperating spring-loaded slot detents located proximate the first terminal end of said slot, and operatively aligned such that sliding movement of the latch pin along said slot towards the first terminal end temporarily urges said first pair of spring-loaded detents outwardly from said slot as the latch pin moves past said first pair of detents and into a first holding position directly adjacent the first terminal end of said slot, thereby temporarily securing the bobbin creel in the raised operating position; and a second pair of cooperating spring-loaded slot detents located proximate the second terminal end of said slot, and operatively aligned such that sliding movement of the latch pin along said slot towards the second terminal end temporarily urges said second pair of spring-loaded detents outwardly from said slot as the latch pin moves past said second pair of detents and into a second holding position directly adjacent the second terminal end of said slot, thereby temporarily securing the bobbin creel in the lowered package donning/doffing position.

11. The creel safety latch according to claim 10, wherein said pivot-control bar defines opposing cylindrical cavities located proximate each of the first and second terminal ends of said slot, and wherein said first and second pairs of spring-loaded slot detents are located substantially within respective opposing cylindrical cavities.

12. The creel safety latch according to claim 11, wherein each detent comprises a metal ball.

13. The creel safety latch according to claim 12, wherein each cylindrical cavity has a reduced diameter opening adjacent said slot, such that a portion of said metal ball is capable of extending outwardly from said cavity and into said slot.

14. The creel safety latch according to claim 13, and comprising a spring located inside each cylindrical cavity and operating to normally urge said metal ball outward from said cavity and into said slot.

15. An overhead bobbin creel adapted for pivoting movement between a raised operating position and a lowered package donning/doffing position, said bobbin creel comprising:

a movable arcuate creel arm comprising at least one package mounting post;

a creel safety latch operatively interconnecting said arcuate creel arm and a pivot linkage attached to an adjacent support frame, said creel safety latch comprising:

an elongated pivot-control bar defining a longitudinal slot having first and second terminal ends, and said slot adapted for receiving a latch pin of said movable arcuate creel arm;

a first pair of cooperating spring-loaded slot detents located proximate the first terminal end of said slot, and operatively aligned such that sliding movement of the latch pin along said slot towards the first terminal end temporarily urges said first pair of spring-loaded detents outwardly from said slot as the latch pin moves past said first pair of detents and into a first holding position directly adjacent the first terminal end of said slot, thereby temporarily securing said bobbin creel in the raised operating position; and a second pair of cooperating spring-loaded slot detents located proximate the second terminal end of said slot, and operatively aligned such that sliding movement of the latch pin along said slot towards the second terminal end temporarily urges said second pair of spring-loaded detents outwardly from said slot as the latch pin moves past said second pair of detents and into a second holding position directly adjacent the second terminal end of said slot, thereby temporarily securing said bobbin creel in the lowered package donning/doffing position.

16. The overhead bobbin creel according to claim 15, wherein said pivot-control bar defines opposing cylindrical cavities located proximate each of the first and second terminal ends of said slot, and wherein said first and second pairs of spring-loaded slot detents are located substantially within respective opposing cylindrical cavities.

17. The overhead bobbin creel according to claim 16, wherein each detent comprises a metal ball.

18. The overhead bobbin creel according to claim 17, wherein each cylindrical cavity has a reduced diameter opening adjacent said slot, such that a portion of said metal ball is capable of extending outwardly from said cavity and into said slot.

19. The overhead bobbin creel according to claim 18, and comprising a spring located inside each cylindrical cavity and operating to normally urge said metal ball outward from said cavity and into said slot.

* * * * *